US005781964A

United States Patent [19]

Lin et al.

[11] Patent Number: 5,781,964

[45] Date of Patent: Jul. 21, 1998

[54] PULL HANDLE ASSEMBLY OF A WHEELED SUITCASE

[75] Inventors: Jerhong Lin; Kuo Chung-Hsien, both of Taipei Hsien, Taiwan

[73] Assignee: Chaw Khong Co., Ltd., Taipei, Taiwan

[21] Appl. No.: 597,314

[22] Filed: Feb. 6, 1996

[51] Int. Cl.[6] ..... A47B 95/02

[52] U.S. Cl. ..... 16/115; 280/655

[58] Field of Search ..... 16/115; 190/39, 190/115, 117; 280/37, 655, 655.1, 47.315, 47.371

[56] References Cited

U.S. PATENT DOCUMENTS

| | | | |
|---|---|---|---|
| 4,546,995 | 10/1985 | Kassai | 280/655 |
| 5,393,079 | 2/1995 | Wang | 280/37 |
| 5,431,428 | 7/1995 | Marchwiak | 280/655 |
| 5,488,756 | 2/1996 | Hsieh | 190/115 |

*Primary Examiner*—A. L. Pitts
*Assistant Examiner*—Mark Williams
*Attorney, Agent, or Firm*—Winston Hsu; Keith Kline

[57] ABSTRACT

A pull handle assembly of a wheeled suitcase which can prevent its lower end from wobbling is disclosed in the present invention. The pull handle assembly comprises one elongated tube mounted in the suitcase having a rectangular channel in it and a pull handle telescopingly received within the channel of the tube. The pull handle comprises an elongated rod member having an upper end and a lower end, a gripping handle installed on the upper end of the rod member for hand gripping, and a rectangular rod guide installed on the lower end of the rod member for guiding the pull handle within the channel. The pull handle assembly further comprises a rod detention means installed under the upper opening of the channel for holding the rod guide of the pull handle to the channel, and three flaps installed on three sides of the rectangular channel next to the rod detention means for restricting the rod guide from wobbling laterally within the channel when the rod guide is being held by the rod detention means.

7 Claims, 4 Drawing Sheets

PULL HANDLE ASSEMBLY OF A WHEELED SUITCASE

BACKGROUND OF THE INVENTION

1. Field of the Invention

The present invention relates to a pull handle assembly of a wheeled suitcase, and more particularly, to a rod receiving mechanism of the pull handle assembly for preventing the pull handle from wobbling laterally when the pull handle is in an extended position.

2. Description of the Prior Art

Pull handles are commonly used in wheeled suitcases for pulling such suitcases. The basic construction of a traditional pull handle assembly comprises at least one elongated tube having a sliding channel in it and a pull handle having a rod guide on its lower end telescopingly mounted within the channel of the tube. A rod detention mechanism is usually installed near the upper opening of the channel to hold the rod guide of the pull handle when the pull handle is pulled up to an extended position. Since the rod guide must be made slidable within the channel, the size of the rod guide is always made smaller than the size of the channel. When the pull handle is pulled up to the extended position, the gap between the rod guide and the channel usually causes the lower end of the rod guide wobbling laterally within the channel when the upper end of the pull handle is held by a user while pulling a wheeled suitcase. Such wobbling effect usually creates a bad feeling to the user because he/she may think that the mechanical structure of the pull handle assembly or even the wheeled suitcase is too loose and not reliable.

U.S. Pat. No. 4,995,487, assigned to Plath, discloses a pull handle assembly which can be used to solve the wobbling problem mentioned above. The pull handle assembly shown in FIG. 4 comprises a rod 18 retractably mounted within a sleeve 28 with an offset guide means 47 which is a cylindrical disk mounted on the lower end of the rod 18. This arrangement causes rod 18 to be slightly curved with respect to the elongate axis of sleeve 28. When the rod 18 reaches its maximum extension, the offset guide means 47 wedge the lower end segment of rod 18 against sleeve 28 and bushing means 27 and bind the rod 18 fictionally in position for use. One problem with such arrangement is that a lot of friction force between the offset guide means 47 and the sleeve 28 will be created by the curve of the rod 18 especially when the offset guide means 47 get closer to the bushing means 27, which makes the movements of the rod 18 difficult.

U.S. Pat. No. 5,335,759, assigned to Yeh, which discloses another pull handle assembly with a friction type retaining device for fictionally holding a bar member within a tubular member, can also be used to solve the wobbling problem mentioned above. The tubular member 32 shown in FIG. 2 comprises a skew hole 24 at its upper end for receiving the bar member 34 so as to make the bar member 34 skew with respect to the tubular member 32 and thus a frictional sleeve 42 attached to the lower end of the bar member 34 is in a frictional engagement with the inside surface of the tubular member 32. With such a frictional engagement, the bar member 34 is allowed to move relative to the tubular member 32 when forcibly pushed or pulled while capable of being maintained at any desirable position along the length of the tubular member 32. Again, the friction force created by the skew hole 24 will force the user to move the handle forcefully all the times which is very inconvenient.

SUMMARY OF THE INVENTION

It is therefore the goal of the present invention to provide a new pull handle assembly to solve the wobbling problem of a traditional pull handle assembly without creating problems mentioned problems mentioned in the above two U.S. patents.

Briefly, in a preferred embodiment, the present invention includes a pull handle assembly for pulling a wheeled suitcase comprising:

(1) at least one elongated tube mounted in the suitcase having a rectangular channel in it with an upper opening;

(2) a pull handle telescopingly received within the channel of the tube, the pull handle comprising a rod member having an upper end and a lower end, a gripping handle installed on the upper end of the rod member for hand gripping, and a rectangular rod guide installed on the lower end of the rod member for guiding the pull handle within the channel;

(3) rod detention means installed under the upper opening of the channel for holding the rod guide of the pull handle to the channel; and (4) three flaps installed on three sides of the rectangular channel next to the rod detention means for restricting the rod guide from wobbling laterally within the channel when the rod guide is being held by the rod detention means.

It is an advantage of the present invention that since the rod guide of the pull handle is tightly restricted with the rectangular channel by the three flaps when the pull handle is held by the rod detention means, the wobbling problem occurred in the traditional pull handle assembly shown in FIG. 1 is totally solved by the new design.

These and other objects and the advantages of the present invention will no doubt become obvious to those of ordinary skill in the art after having read the following detailed description of the preferred embodiment which is illustrated in the various figures and drawings.

DETAILED DESCRIPTION OF THE PREFERRED EMBODIMENT

Figure 1:
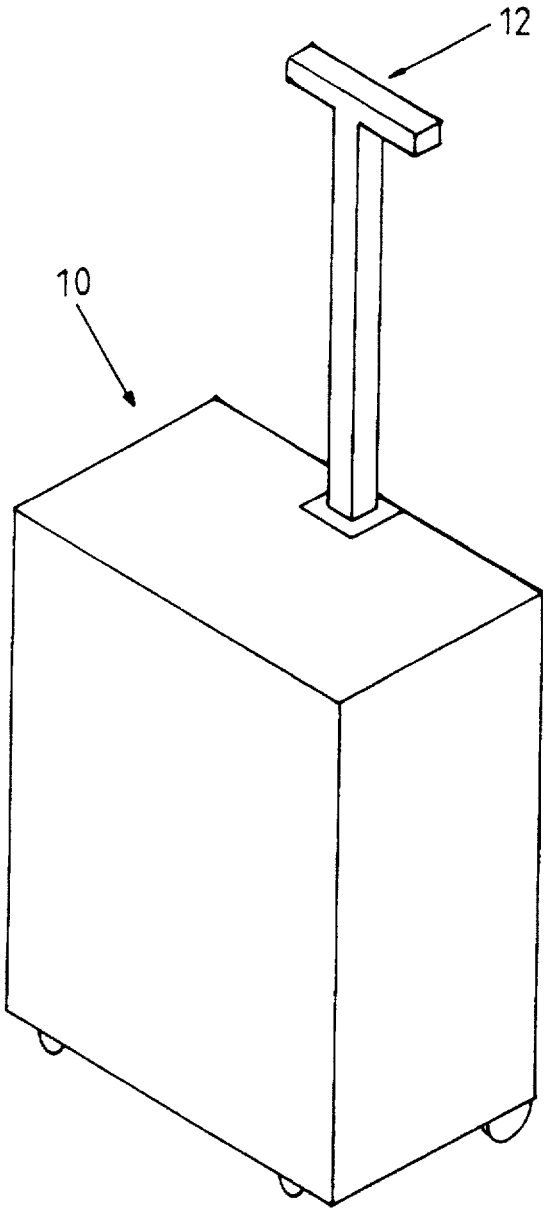
FIG. 1 is a perspective view of a wheeled suitcase equipped with a pull handle assembly for pulling the suitcase.
Figure 2:
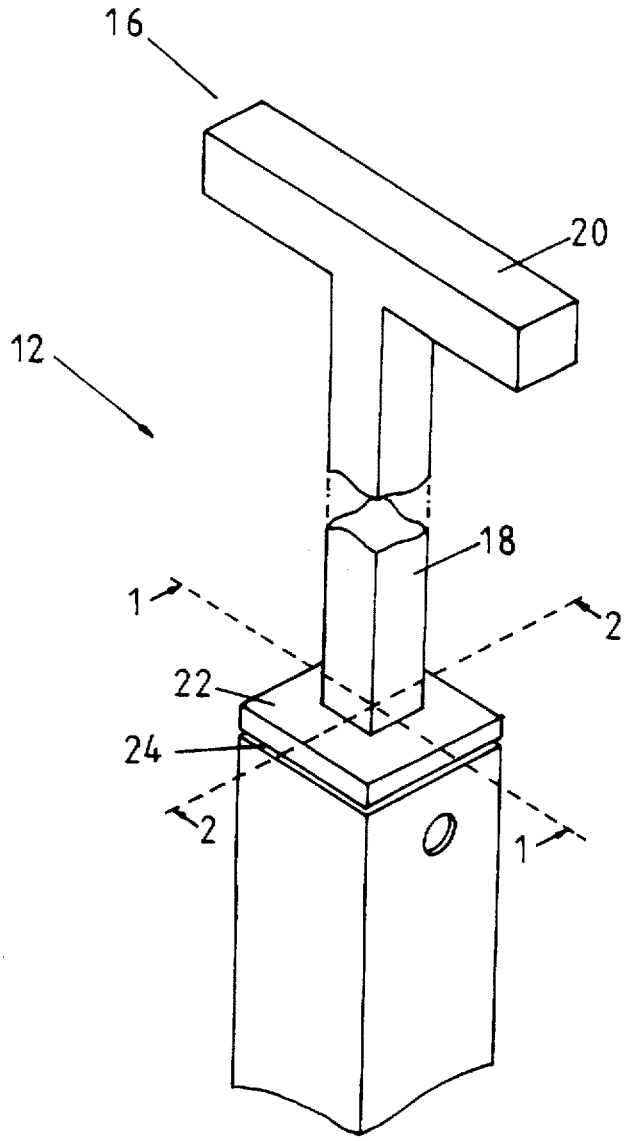
FIG. 2 is a perspective view of part of the pull handle assembly shown in FIG. 1.

FIG. 1 is a perspective view of a wheeled suitcase 10 equipped with a pull handle assembly 12 for pulling the suitcase 10, and FIG. 2 is a perspective view of part of the pull handle assembly 12. The pull handle assembly 12 comprises an elongated tube 14 mounted in the suitcase 10, a pull handle 16 telescopingly mounted in the tube 14 and a head cover 22 mounted on the upper opening 24 of the tube 14 for restricting the pull handle 16 from being pulled out of the tube 14. The pull handle 16 comprises a rod member 18 having a gripping handle 20 installed on the upper end of the rod member 18 for hand gripping.

Figure 3:
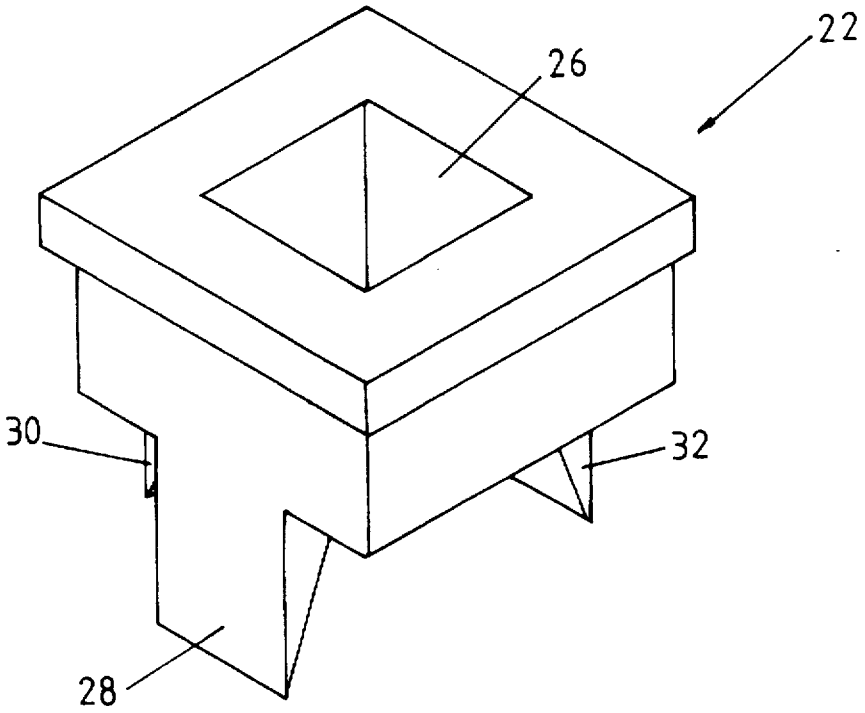
FIG. 3 is a perspective view of the head cover shown in FIG. 2.

FIG. 3 is a perspective view of the head cover 22 shown in FIG. 2. The head cover 22 which is a plastic piece comprises an upper opening 26 for allowing the rod member 18 to pass through and three downward protruding flaps 28, 30 and 32 installed on three sides of the rectangular head cover 22.

Figure 4:
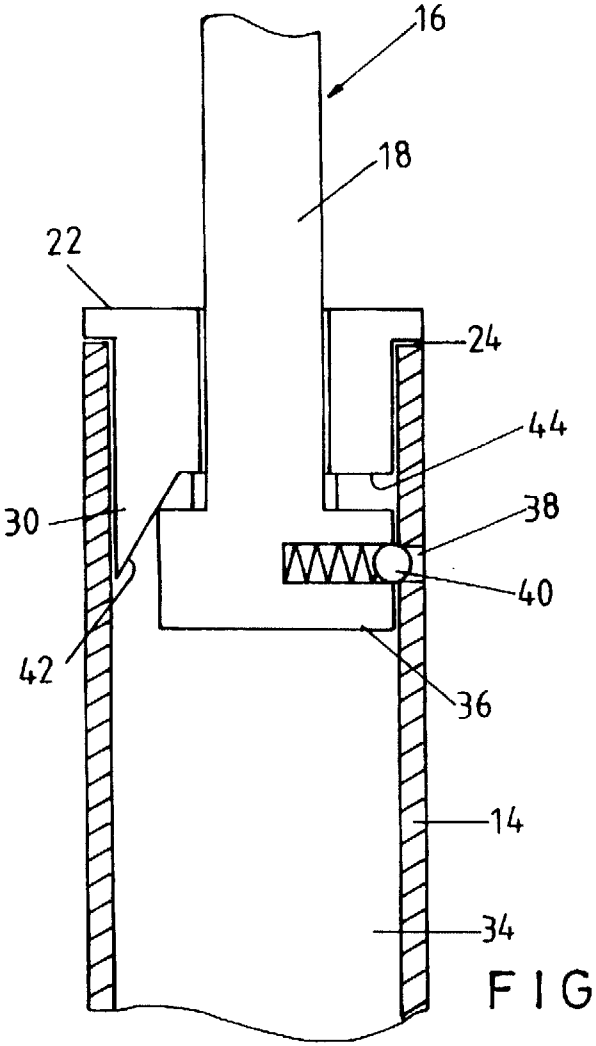
FIG. 4 is a sectional view 1—1 of FIG. 2 which shows the construction of part of the pull handle assembly.

FIG. 4 is a sectional view 1—1 of FIG. 2 which shows the construction of part of the pull handle assembly 12. It shows that the tube 14 comprises a rectangular channel 34 in it. The pull handle 16 is telescopingly received within the channel 34 and the head cover 22 is fixedly mounted on the upper opening 24 of the tube 14 for restricting the pull handle 16 from being pulled out of the tube 14. The rod member 18 comprises a rectangular rod guide 36 installed on its lower end for guiding the pull handle 16 within the channel 34. A hole 38 is installed under the upper opening 24 of the channel 34 for engaging and holding the rod guide 36 to the channel 34, and the rod guide 36 further comprises a spring-biased ball 40 for sticking to the hole 38. Both the hole 38 and the spring-biased ball 40 function as a rod detention means for holding the rod guide 36 to the channel 34 when the pull handle 16 is pulled to an extended position as shown in FIG. 4.

The flap 30 of the head cover 22 is installed on the opposite side of the hole 38 inside the channel 34 for pressing the rod guide 36 against the hole 38 to prevent it from wobbling. The flap 30 comprises an engaging ramp 42 for engaging and pressing the rod guide 36 against the other side of the channel 34 to prevent it from wobbling laterally when the spring-biased ball 40 of the rod guide 36 is being held over the hole 38. The head cover 22 further comprises an edge 44 on its lower end located above the hole 38 which functions as a rod stop to prevent the rod guide 36 from being pulled out of the tube 14.

Figure 5:
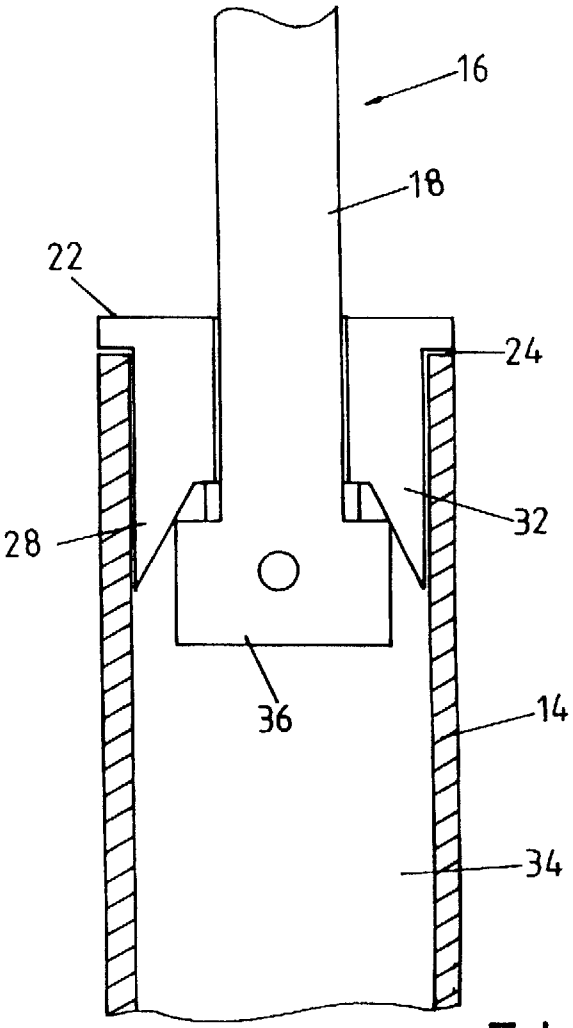
FIG. 5 is another sectional view 2—2 of FIG. 2.

FIG. 5 is another sectional view 2—2 of FIG. 2. It shows that the two flaps 28 and 32 are installed on two opposite sides of the channel 34 for preventing the rod guide 36 from wobbling laterally. Since the channel 34 and the rod guide 36 are both rectangular, one flap such as the flap 30 shown in FIG. 4 is enough to substantially reduce the wobbling of the rod guide 36 within the channel 34. For completely eliminating the wobbling effect, three flaps 28, 30 and 32 are provided on the three sides of the channel 34 next to the hole 38 to avoid wobbling of the rod guide 36.

The above disclosure is not intended as limiting. Those skilled in the art will readily observe that numerous modifications and alterations of the device may be made while retaining the teachings of the invention. Accordingly, the above disclosure should be construed as limited only by the metes and bounds of the appended claims.

What is claimed is:

1. A pull handle assembly for pulling a wheeled suitcase comprising:

(1) an elongated tube mounted in the suitcase having a channel in it with an upper opening;

(2) a pull handle telescopingly received within the channel of the tube, the pull handle comprising a rod member having an upper end and a lower end, a gripping handle installed on the upper end of the rod member for hand gripping, and a rod guide installed on the lower end of the rod member for guiding the pull handle within the channel;

(3) rod detention means installed under the upper opening of the channel for holding the rod guide of the pull handle to the channel; and (4) at least one flap having an engaging ramp installed on one side of the channel next to the rod detention means for engaging and pressing the rod guide of the pull handle against an opposite side of the channel to prevent it from wobbling when the rod guide is being held by the rod detention means.

2. The pull handle assembly of claim 1 wherein the channel within the tube is a rectangular channel and the rod guide of the pull handle is in a rectangular shape which is slidingly received within the rectangular channel.

3. The pull handle assembly of claim 2 wherein the rod detention means is installed on one side of the rectangular channel and there are three flaps installed on the other three sides of the channel for preventing the rod guide from wobbling laterally.

4. The pull handle assembly of claim 1 comprising two flaps installed on two opposite sides of the channel for preventing the rod guide from wobbling laterally.

5. The pull handle assembly of claim 1 further comprising a rod stop installed above the rod detention means for preventing the rod guide from being pulled out of the tube.

6. The pull handle assembly of claim 7 wherein the rod stop and the flap are made in one plastic piece which is fixedly mounted to the upper opening of the channel.

7. A pull handle assembly for pulling a wheeled suitcase comprising:

(1) an elongated tube mounted in the suitcase having a rectangular channel in it with an upper opening;

(2) a pull handle telescopingly received within the channel of the tube, the pull handle comprising a rod member having an upper end and a lower end, a gripping handle installed on the upper end of the rod member for hand gripping, and a rectangular rod guide installed on the lower end of the rod member for guiding the pull handle within the channel;

(3) rod detention means installed under the upper opening of the channel for holding the rod guide of the pull handle to the channel; and (4) three flaps installed on three sides of the rectangular channel next to the rod detention means, each of the three flaps comprising an engaging ramp for engaging and restricting the rod guide from wobbling laterally within the channel when the rod guide is being held by the rod detention means.

* * * * *